United States Patent [19]

Schwarzmann

[11] 4,443,772

[45] Apr. 17, 1984

[54] SWITCHING MICROWAVE INTEGRATED BRIDGE T GROUP DELAY EQUALIZER

[75] Inventor: Alfred Schwarzmann, Mount Laurel, N.J.

[73] Assignee: RCA Corporation, New York, N.Y.

[21] Appl. No.: 329,338

[22] Filed: Dec. 10, 1981

[51] Int. Cl.[3] ..... H01P 1/20

[52] U.S. Cl. ..... 333/28 R; 333/170; 333/246

[58] Field of Search ..... 333/24 C, 28 R, 170, 333/171, 204, 205, 238, 246

[56] References Cited

U.S. PATENT DOCUMENTS

| | | | |
|---|---|---|---|
| 3,087,126 | 4/1963 | Szczuka | 333/28 R |
| 3,768,047 | 10/1973 | Campbell et al. . | |
| 3,781,722 | 12/1973 | Pierson | 333/28 R X |
| 4,035,747 | 7/1977 | Hindermayr et al. | 333/28 R |
| 4,251,783 | 2/1981 | Yamada et al. . | |
| 4,270,104 | 5/1981 | Schwarzmann | 333/28 R |
| 4,275,367 | 6/1981 | Gaglione et al. | 333/246 X |

FOREIGN PATENT DOCUMENTS

| | | | |
|---|---|---|---|
| 1286572 | 1/1969 | Fed. Rep. of Germany | 333/28 R |

*Primary Examiner*—Paul L. Gensler

*Attorney, Agent, or Firm*—Joseph S. Tripoli; Robert L. Troike; Robert Ochis

[57] ABSTRACT

A microwave group delay equalizer in microstrip form comprises a dielectric substrate having a ground plane on one surface and on the other surface two conductive strips oriented end to end and spaced apart by a narrow gap and connected together by a relatively narrow inductive conductive strip of substantially greater length than the gap between the first two strips. A dielectric layer overlies the adjacent ends of the first two conductor strips. A fourth conductor strip is disposed over the dielectric layer to provide capacitive coupling between the first and second conductors. The fourth conductor is connected to a grounded capacitor by a fifth relatively narrow inductive conductive strip.

7 Claims, 6 Drawing Figures

SWITCHING MICROWAVE INTEGRATED BRIDGE T GROUP DELAY EQUALIZER

Figure 1:
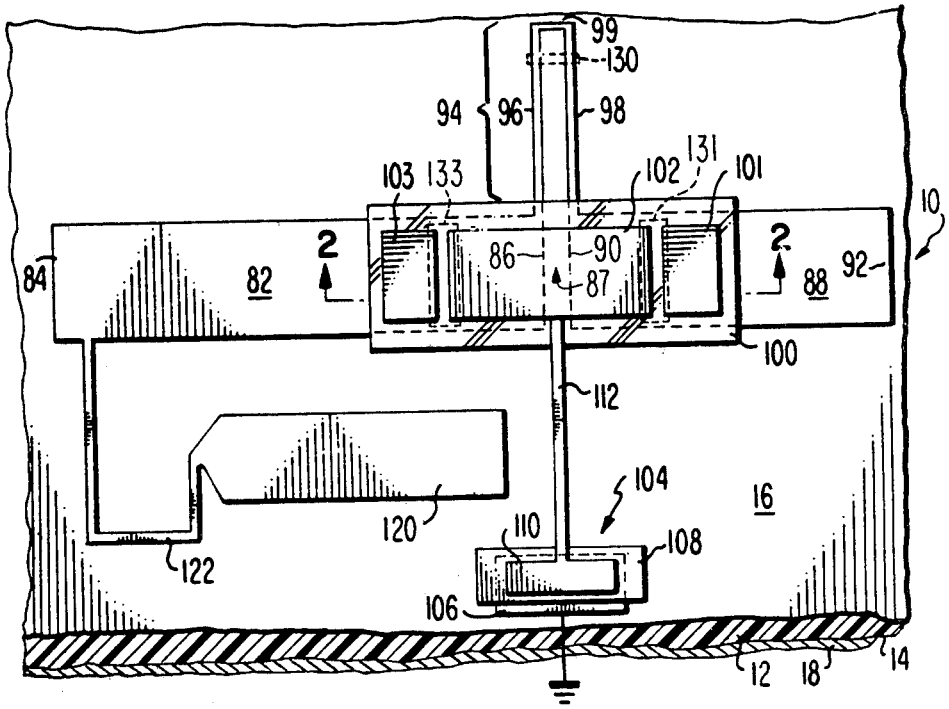

This invention relates to the field of microwave circuits and more particularly to microwave group delay equalizers.

Most microwave circuits do not inherently have a flat phase characteristic over a designed operating frequency band. As a result, broadband signals propagating in such circuits experience delay-distortion which distorts pulse shapes and other signal characteristics in an undesirable manner. Group delay equalizers are added to microwave circuits to establish a constant delay over an operating frequency band in order to prevent this type of signal distortion.

Microwave group delay equalizers employing circulators to provide equalization via reflection are known in the art. Such equalizers are relatively bulky, are lossy because of the presence of the circulator, are generally only effective for signal transmission in one direction because of the circulator and are rather expensive.

Bridge T and lattice networks constructed of discrete components are effective as group delay equalizers in the 30–70 MHz frequency range and are well known in the art. Such equalizers are ineffective at microwave frequencies which are well above the upper frequency limit of such networks.

A low-loss, inexpensive bidirectional group delay equalizer is needed for microwave frequency applications.

In accordance with one preferred embodiment of the present invention, a group delay equalizer in microstrip form comprises a dielectric substrate having a ground plane along a first major surface thereof and on the second major surface thereof first and second strip conductor transmission lines positioned end to end but spaced from each other. These transmission lines are inductively coupled by a connecting third strip conductor which is relatively narrow and is relatively long compared to the gap between the first and second conductors to provide inductive coupling. A dielectric layer overlies the adjacent ends of the first and second strip conductors and is in turn overlain by a fourth conductive strip which forms capacitors with the first and second strip conductors to provide capacitive coupling between the first and second transmission lines. The fourth strip conductor is inductively coupled to a grounded capacitor by a fifth relatively narrow conductive strip.

Figure 6:
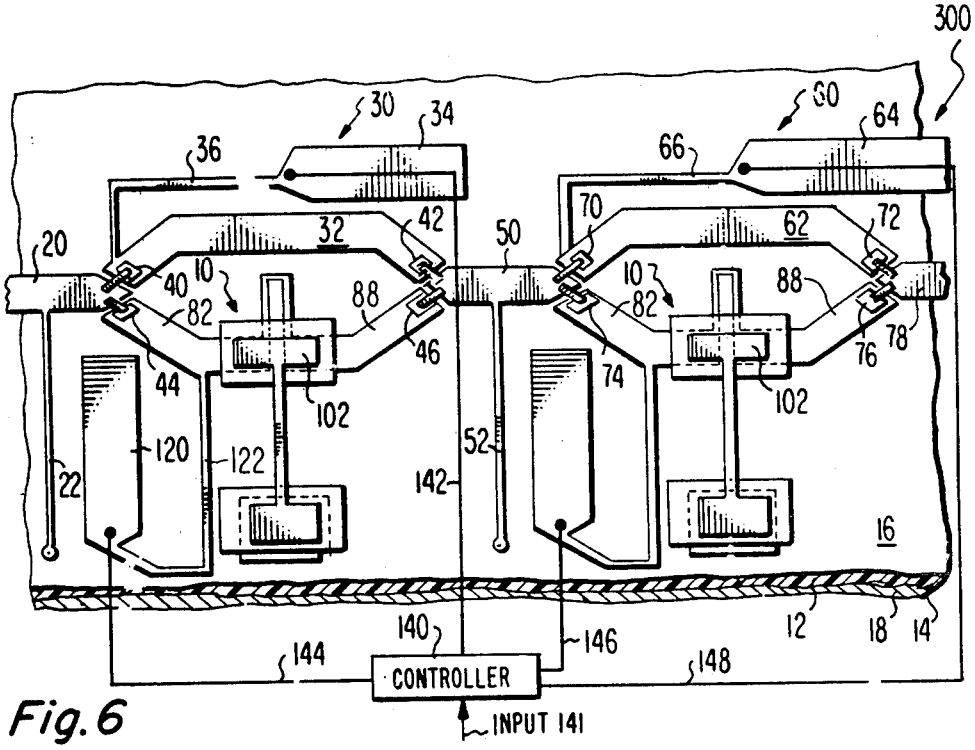
Figure 3:
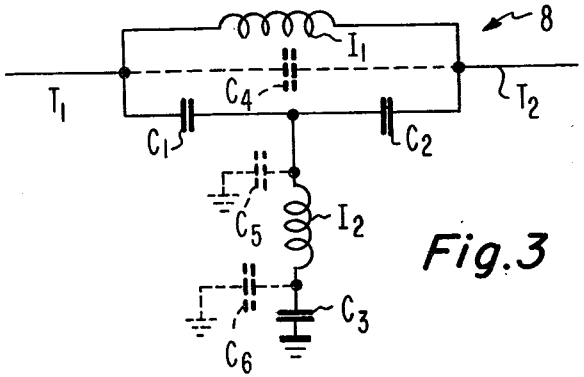
Figure 5:
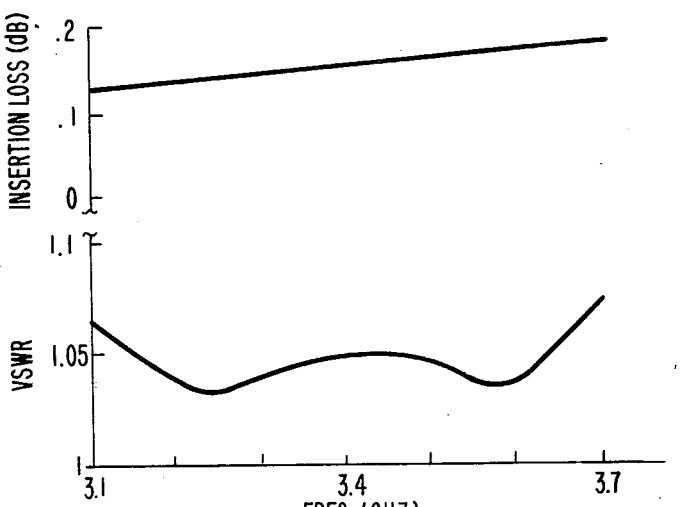
Figure 2:
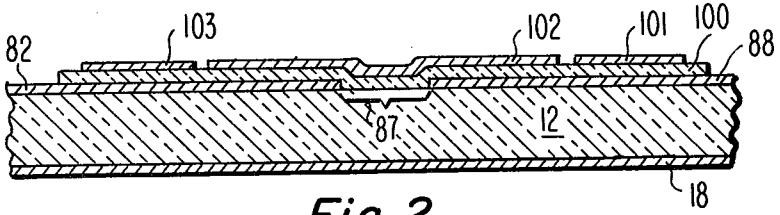
Figure 4:
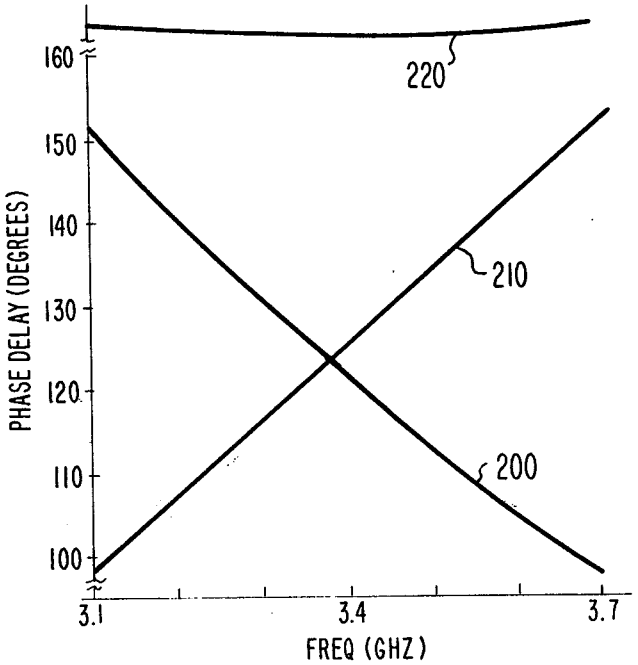

In the drawing:

FIG. 1 is a plan view of the group delay equalizer in accordance with a preferred embodiment of the invention, FIG. 2 is a cross-section through FIG. 1 taken along the line 3—3, FIG. 3 is a schematic diagram of a lumped constant, bridge-T group delay equalizing network, FIG. 4 graphs the phase verses frequency response characteristic of an unequalized microwave circuit, the phase versus frequency characteristics of a compensating group delay equalizer and the resulting substantially flat phase characteristic of the combined circuit, FIG. 5 graphs the VSWR and loss verses frequency characteristics of the equalizer whose phase response is graphed in FIG. 4, and FIG. 6 illustrates a cascade of two successive switchable group delay equalization sections in accordance with the invention.

The structure of a group delay equalizer 10 in accordance with the invention is illustrated in FIG. 1. Group delay equalizer 10 is fabricated as an integrated microwave microstrip circuit on a dielectric substrate 12 having first and second major surfaces 14 and 16, respectively. A ground conductor 18 covers the first major surface 14 of substrate 12. Narrow strip-like conductors forming the transmission line circuit of the group delay equalizer 10 are disposed on the second major surface 16 of the substrate 12.

The microstrip circuitry on the upper surface 16 of substrate 12 includes a first strip conductor 82 which with ground conductor 18 and substrate 12 forms a first transmission line $T_1$ a second strip conductor 88 which with ground conductor 18 and substrate 12 forms a second transmission line $T_2$. Conductor 82 has an input end 84 and an output end 86 which is aligned with and adjacent to, but spaced from an input end 90 of the second strip conductor 88 which has an output end 92. The output end 86 of the first transmision line and the input end 90 of the second transmission line although spaced apart by a gap 87 are connected by a relatively narrow, relatively long strip conductor 94 which has a first segment 96 connecting to output end 86 of conductor 82, a second segment 98 connnecting to the input end 90 of conductor 88 and a third joining segment 99. The strip 94 has a length and a relatively narrow width compared to width of conductors 82 and 88 to provide an inductive impedance at the operating frequencies of the equalizer. A dielectric layer 100 overlies conductors 82 and 88 in the vicinity of their adjacent ends. A fourth strip conductor 102 overlies the dielectric layer 100 and at least part of each of conductors 82 and 88 to provide capacitive coupling between transmission line $T_1$ and conductor 102 and between conductor 102 and transmission line $T_2$. A grounded capacitor 104 is connected to conductor 102 by a relatively narrow conductor strip 112. The strip 112 is narrow and long such that at the operating frequencies it appears inductive like conductor 94. Capacitor 104 comprises a grounded conductive plate 106 with an overlying layer 108 of dielectric material on which a conductive strip 110 is disposed to serve as the other plate of the capacitor. Conductor strip 110 overlies dielectric layer 108 and is continuous with conductor 112. A bias connection pad 120 is connected to input conductor 82 by a narrow conductor strip 122 which serves as a radio frequency choke.

Although this group delay equalizer 10 has been discussed in terms of its input being line 82 and its output being line 88, it is equally effective if the roles of conductors 82 and 88 are reversed.

FIG. 2 illustrates in cross-section the portion of the group delay equalizer in the vicinity of the gap between conductors 82 and 88.

The group delay equalizer 10 functions at microwave frequencies in a manner analogous to the functioning of a lumped constant bridge-T network in that it has a similar equivalent circuit but with added distributed elements but because of its configuration and design is effective at microwave frequencies unlike lumped constant, bridge-T networks.

A lumped constant bridge-T equivalent circuit 8 of a group delay equalizing network 10 of FIG. 1 is illustrated in FIG. 3. $T_1$ is the input transmission line formed with conductor 82 and $T_2$ is the output transmission line formed with conductor 88. Network 8 connects transmission line $T_1$ to transmission line $T_2$ via an inductor $I_1$, in parallel with a series connection of two capacitors $C_1$ and $C_2$ and a distributed capacitor $C_4$. Strip conductor 94 corresponds to inductor $I_1$, of FIG. 3 and provides inductive coupling between conductors 82 and 88 and has a length and width to behave inductively at the operating frequency band. The length is at least twice the separation 87 between conductors 82 and 88. The capacitive coupling from conductor 82 to conductor 102 provides capacitor $C_1$ in FIG. 3 and the capacitive coupling from conductor 102 to conductor 88 provides capacitor $C_2$ in FIG. 3. Narrow strip 112 and grounded capacitor 104 provide series LC network comprised of inductor $I_2$ and capacitor $C_3$ connected between the common node of capacitors $C_1$ and $C_2$ and ground. Inductor $I_2$ is also connected to ground by two distributed capacitors $C_5$ and $C_6$. The distributed capacitors $C_4$, $C_5$ and $C_6$ of FIG. 1 are a result of the microstrip construction of this group delay equalizer.

The non-distributed elements ($I_1$, $I_2$, $C_1$, $C_2$ and $C_3$) are similar to the elements present in lumped constant bridge-T networks designed for operation in the less than 100 MHz frequency range.

The center frequency of the equalizer is most sensitive to the impedance of the conductor 94 and capacitors $C_1$ and $C_2$ which couple conductors 82 and 88. However, the center frequency and the frequency range of the characteristic is also sensitive to the capacitance 104 and the inductance 112. In order to obtain a flat amplitude characteristic across the frequency range of interest, the impedance of each of the portions of the circuit must be properly matched. In consequence, the most effective way of optimizing a group delay equalizer of this type is through computer-aided design. It will be recognized that, for a given characteristic, a wider conductor 112 will need to be longer to provide the same effective inductance and the same is true of the conductor 94. The width of the conductors 94 and 112 is preferably in the range of $\frac{1}{4}$ to 1/5 the width of the conductors 82 and 88. However, it will be recognized that this width ratio may vary significantly from $\frac{1}{3}$ down to 2/13.

A group delay equalizer 10 in accordance with this invention was fabricated for operation in the frequency range from 3.1 to 3.7 GHz. A dielectric substrate of alumina 0.04 inches (0.1 cm) thick was utilized. The ground conductor 18 was thick film copper 0.0005 inches (0.0013 cm) thick. The conductor strips 82 and 88 were 0.039 inches (0.099 cm) wide copper 0.0005 inches (0.0013 cm) thick. Conductors 82 and 88 were spaced from each other by 0.01 inches (0.0254 cm). Conductor 94 had a total length of 48 electrical degrees and was 0.006 inches (0.015 cm) wide. In actual fabrication, conductors 82, 88 and 94 are a single continuous conductor defined by screen printing techniques. The dielectric layer 100 is a thick film dielectric 0.002 inches (0.005 cm) thick. The conductor 102 was designed to produce 1 pF of capacitance with each of the conductors 82 and 88 and is 0.06 inches (0.15 cm) long parallel to the length of the conductors 82 and 88 and 0.039 inches (0.099 cm) wide and was 0.0005 inches (0.0013 cm) thick copper.

The lower plate 106 of the capacitor 104 was the ground conductor 18 on the lower surface of the substrate. The dielectric layer 108 is a thick film dielectric 0.002 inches (0.0051 cm) thick. The conductor strip 110 forming the upper plate of the capacitor 104 was sized to provide 20 pF of capacitance. The conductor 112 connecting the plate 110 to the conductor 102 was 0.006 inches (0.015 cm) wide and 21 electrical degrees long and was also copper 0.0005 inch (0.0013 cm) thick. Again in fabrication, the conductor 102, the conductor 112 and the conductor 110 were a single continuous piece of copper. The RF choke 122 was 90 electrical degrees long by 0.005 inches (0.013 cm) wide by 0.0005 inches (0.0013 cm) thick.

The group delay equalizer 10 discussed above was tested and has the phase versus frequency response illustrated by curve 200 in FIG. 4 and the VSWR and loss versus frequency responses illustrated in FIG. 5. This equalizer was designed to compensate a typical microwave circuit characteristic such as shown by curve 210 in FIG. 4 and when connected in series with such a circuit produces an overall phase verses frequency characteristic such as 220 in FIG. 4, thus effective compensation is provided over the frequency range 3.1 to 3.7 GHz.

The phase versus frequency characteristic of the particular equalizer 10 embodiment discussed above is represented by curve 200 in FIG. 4. The equalizer 10 has a negative slope characteristic in that delay decreases with increase in frequency to compensate for the positive slope characteristic of microwave circuits that have a delay that increases with increase in frequency.

If it is desired to change the center frequency of this group delay equalizer, the center frequency may be increased by the addition of a bridging conductor 130 in FIG. 1 to connect the portions 96 and 98 of conductor 94 in a manner to shorten the effective length of conductor 94. The conductor 130 is shown in phantom since it is not a necessary part of the circuit and is added to change the circuit's characteristics. The conductor 130 may be soldered to the conductive line 96 and 98. The center frequency can be decreased by the addition of bridging conductors 131 and 133 to connect conductors 101 and 103 (which overlie dielectric 100) to conductor 102. This increases the plate area of the capacitors $C_1$ and $C_2$ and increases capacitive coupling between conductors 82 and 88. Conductors 131 and 133 are shown in phantom since they are not a necessary part of the circuit and are added to change the circuit's characteristics.

If it is desired to decrease the negative slope of curve 200, this can be accomplished by increasing the impedance of line 94 ($I_1$) by lengthening line 94 and by slightly increasing the impedance of line 112 ($I_2$) by slightly lengthening that line.

If it is desired to broaden the frequency range over which this equalizer is effective, this can be done by narrowing and shortening line 112 to increase its impedance while also narrowing and shortening line 94 to increase its impedance. This has the effect of reducing the negative slope as well as widening the effective frequency range.

A cascade of switchable equalization sections allows a circuit connected in series with the switchable equalizers to be compensated over a substantial number of subranges of frequency response in accordance with the signals being propagated at a given time. A switchable group delay equalizer 300 (FIG. 6) in accordance with the invention comprises a series cascade of two switchable group delay equalization sections 30 and 60. The whole switchable equalizer 300 is formed on a dielectric substrate 12 having on one surface 14 a broad planar conductor 18 and on the opposite surface 16 narrow strip-like conductors. A first strip conductor 20 on surface 16 serves as input conductor for the switchable group delay equalizer 300 and connects to the first equalization section 30 which comprises two parallel circuit paths, a strip conductor 32 in a first path and a group delay equalizer 10 in a second path. Both paths connect to a common output conductor 50. Strip conductor 32 is the normal, by-pass or unequalized branch of switchable equalization section 30 and is connected to the input conductor 20 by a P-I-N diode 40 and to the output conductor 50 by a P-I-N diode 42. The group delay equalizer 10 (like that discussed above in connection with FIG. 1) is connected to the input conductor 20 by a P-I-N diode 44 and to the output conductor 50 by a P-I-N diode 46. A narrow conductor strip 22 connects the input conductor 20 to ground. The conductor 22 is long and narrow to serve at the operating frequencies as a radio frequency choke to prevent propagation of microwave signals along the path 22 while allowing DC bias signals for the diodes to return to ground. A similar radio frequency choke 52 connects the output conductor 50 to ground. Both diodes 40 and 42 have their anodes attached to conductor strip 32 and receive a dc bias signal from a bias pad 34 through an RF choke 36. Similarly, the diodes 44 and 46 have their anodes connected to the group delay equalizer 10 and receive a DC bias signal from a bias pad 120 through an RF choke 122. The group delay equalizer 10 is switched out of the microwave signal propagation path by forward biasing diodes 40 and 42 and reverse biasing diodes 44 and 46. The group delay equalizer 10 is switched into the microwave frequency propagation path by reverse biasing diodes 40 and 42 and forward biasing diodes 44 and 46. D. C. bias voltages for controlling the states of the diodes are supplied by a controller 140 on bias line 142 for diodes 40 and 42 and on line 144 for diodes 44 and 46. Controller 140 establishes the appropriate bias voltages for the desired state of the equalizer bit 30 in response to commands received at its input 141 from an external group propagation delay equalization selector (not shown).

The first selectable group delay equalizer section 30 is followed by a second selectable group delay equalizer section 60 which is of similar construction and has an output conductor 78 and diode bias control lines 146 and 148 connecting it to controller 140. Section 60 contains a strip conductor 62 which is similar to the strip conductor 32 of section 30. Similarly, diodes 70, 72, 74 and 76 of section 60 correspond respectively to diodes 40, 42, 44 and 46 of section 30. The bias pad 64 and RF choke 66 of section 60 correspond to bias pad 34 and RF choke 36 of section 30. The second selectable equalizer section 60 will generally contain a group delay equalizer 10 which has a different phase versus frequency characteristic than the group delay equalizer 10 in the first section 30. However, if desired the two group delay equalizers 10 may be identical.

For some systems and some frequencies, only one of the equalizer sections 30 or 60 will need to be switched into the signal path while for other frequencies both or more may have to be switched into the signal path to provide a desired degree of equalization. This depends in part on the initial characteristics of the circuit to be compensated and in part on the characteristics of the individual equalizers.

In a frequency agile system in which operating frequencies are changed frequently and rapidly, the fast switching of the P-I-N diodes enables the equalizing network to properly equalize each new operating frequency as its use commenses.

In fixed frequency communication systems individual channels of a multichannel system can be more permanently compensated while still being changeable in the event of channel or frequency re-allocation.

What is claimed is:

1. A group delay equalizer for compensating for increasing group delay for increasing frequency over a given band of microwave frequencies above one Gigahertz comprising:

first and second strip conductors spaced end to end from each other and on one surface of a dielectric substrate having a ground conductor on the opposite surface of said substrate to form two transmission lines;

a third, relatively narrow, strip conductor forming an inductor at said given band of frequencies and connecting said first and second conductors to provide a series inductive coupling between them;

a dielectric body overlying adjacent end portions of said first and said second conductors;

a fourth strip conductor overlying said dielectric material, at least a part of said first conductor and at least a part of said second conductor, and of a width to form a series of first and second capacitors between said two transmission lines;

a grounded capacitor connected to said fourth conductor and therefore at the junction of said first and second capacitors by a fifth, relatively narrow, strip conductor forming an inductor at said given band of frequencies which provides inductive coupling between said fourth conductor and said grounded capacitor; and said third and fifth conductor effective lengths and widths being selected together with the values of said first, second, and grounded capacitors to produce a compensating decrease in group delay for increasing frequency.

2. The microwave equalizer of claim 1 wherein said third and fifth conductor lengths are no more than $\frac{1}{3}$ as wide as said first and second conductors and being at least twice as long as the space between said first and second conductors.

3. The microwave equalizer recited in claim 1 wherein said third and fifth conductors effective lengths and said fourth strip conductor area are selected to produce a compensating decreasing delay for incresing frequency characteristic.

4. The microwave equalizer recited in claim 1 wherein said third strip conductor has first and second parallel closely spaced portions connected together at their ends remote from said first and second conductors whereby the effective length of said first relatively narrow conductor can be reduced by the addition of a bridging conductor connecting the first and second parallel portions closer to said first and second conductors than the remote ends of first and second portions of said third strip conductor.

5. The microwave equalizer recited in claim 4 including an isolated conductor segment overlying said dielectric body and suitable for connection to said fourth conductor to increase the capacitance between said third conductor and at least one of said first and second conductors.

6. A switchable group delay equalization system for selectively providing a positive slope compensating group delay for signals having frequencies in a microwave band of frequencies above one Gigahertz, said system comprising:

a group delay equalization network for a given frequency band including:

first and second strip conductors spaced end to end from each other and on one surface of a dielectric substrate having a grounded conductor on the opposite surface of said substrate to form two transmission lines;

a third, relatively narrow, strip conductor connecting said first and second conductors; said third strip conductor being of a length and width to provide inductive coupling between said two transmission lines;

a dielectric body overlying at least part of said first conductor and at least part of said second conductor;

a fourth strip conductor overlying said dielectric material and at least a part of said first conductor and at least a part of said second conductor to provide capacitive coupling between the two transmission lines;

a grounded capacitor connected to said fourth conductor by a fifth, relatively narrow, strip conductor, said fifth conductor being of a length and width to provide inductive coupling between said fourth conductor and said grounded capacitor;

said third and fifth conductor lengths and widths being selected together with the size of said fourth conductors and the value of said grounded capacitor to provide a compensating decrease in group delay vs. frequency characteristic over said given band;

a sixth conductor strip disposed on said substrate in parallel with but spaced from said first and second conductors to form a third transmission line;

a seventh conductor adjacent said first conductor and said sixth conductor;

an eighth conductor adjacent said second conductor and said sixth conductor;

a P-I-N diode switch system for selectively connecting said sixth conductor to said seventh conductor and said eighth conductor or said first conductor to said seventh conductor and said second conductor to said eighth conductor to direct RF energy through said sixth conductor or through said first and second conductor strips in accordance with the state of said switch system; and control means for controlling state of said P-I-N diode switch system.

7. The microwave switchable group delay equalization system recited in claim 6 further comprising:

a second of said group delay equalization networks connected in series with said previously recited group delay equalization network, said second network being for a different microwave frequency band than said first recited network.

* * * * *